US012220071B1

(12) United States Patent
Jiang

(10) Patent No.: US 12,220,071 B1
(45) Date of Patent: Feb. 11, 2025

(54) HAT RACK FOR BASEBALL CAP

(71) Applicant: Zhongyi Jiang, Nanchang (CN)

(72) Inventor: Zhongyi Jiang, Nanchang (CN)

( * ) Notice: Subject to any disclaimer, the term of this patent is extended or adjusted under 35 U.S.C. 154(b) by 0 days.

(21) Appl. No.: 18/794,524

(22) Filed: Aug. 5, 2024

(51) Int. Cl.
*A47G 25/10* (2006.01)
*A47F 5/00* (2006.01)

(52) U.S. Cl.
CPC ..... *A47G 25/10* (2013.01); *A47F 5/0006* (2013.01); *A47F 2005/0012* (2013.01)

(58) Field of Classification Search
CPC ..... A42B 1/002; A47G 25/10; A47F 5/0006; A47F 2005/0012
See application file for complete search history.

(56) References Cited

U.S. PATENT DOCUMENTS 4,718,962 A * 1/1988 Goodwin ..... A47K 3/38 156/247
D324,960 S * 3/1992 Rodack ..... D6/320
5,096,070 A * 3/1992 Jaynes ..... A47F 5/0006 211/85.15
5,240,123 A * 8/1993 Hawk ..... A47F 5/0807 211/32
5,346,166 A * 9/1994 Valiulis ..... A47F 5/0068 248/301
5,628,414 A * 5/1997 Heathcote ..... G11B 33/0461 211/40
5,683,003 A * 11/1997 Gebka ..... A47F 5/0884 211/113
5,897,709 A * 4/1999 Torefors ..... B05B 5/082 118/500
5,921,403 A * 7/1999 Coffaro ..... A47F 7/06 211/32
6,112,909 A * 9/2000 Moseley ..... A47G 25/10 403/322.2
6,223,910 B1 * 5/2001 Levin ..... A47F 7/06 211/113
6,289,563 B1 * 9/2001 Watkins ..... E06B 9/367 428/40.1
6,648,171 B2 * 11/2003 Rink, Jr. ..... A41D 3/08 221/26
6,951,290 B2 * 10/2005 Speed ..... A47F 5/0068 211/113
7,451,801 B2 * 11/2008 Park ..... E06B 9/367 160/173 V (Continued)

FOREIGN PATENT DOCUMENTS

CN 104305825 A 1/2015
CN 204541638 U 8/2015
CN 208625232 U 3/2019

*Primary Examiner* — Ko H Chan
(74) *Attorney, Agent, or Firm* — George D. Morgan

(57) ABSTRACT

A hat rack for baseball cap includes a main body which is provided with a vertical support surface. The support surface is provided with a plurality of connection ports arranged in a row from top to bottom, and each of the connection ports is provided with a lower support platform and an upper positioning platform located above the lower support platform respectively. A bottom surface of the upper positioning platform forms a limiting portion which sinks upward. The invention can store a large number of baseball caps in a more standardized manner, so that the caps are not easy to fall off, a single cap is easier to take and put, and the structure is simple and reliable.

9 Claims, 15 Drawing Sheets

(56) References Cited

U.S. PATENT DOCUMENTS

| | | | | |
|---|---|---|---|---|
| 7,712,616 | B2 * | 5/2010 | Barkdoll | A47F 5/0807 211/59.1 |
| 11,122,924 | B2 * | 9/2021 | Williams, Jr. | A47F 5/0876 |
| D1,039,846 | S * | 8/2024 | Jiang | D6/320 |
| 2022/0047101 | A9 * | 2/2022 | Quezada | A47F 7/06 |
| 2023/0301451 | A1 * | 9/2023 | Park | A47G 25/10 |

* cited by examiner

HAT RACK FOR BASEBALL CAP

TECHNICAL FIELD

The invention relates to a hat storage technology, in particular to a hat rack for baseball cap.

BACKGROUND

The baseball cap is a hat that developed along with the sport of baseball. It was originally a special item for athletes, but now it is widely used as an everyday wear around the world.

As shown in FIG. 1, a baseball cap is usually composed of a visor 91 and a cap body 92, and a top buckle 93 is provided at the center of the top of the cap body. Typically, when sold in stores and as personal collections, baseball caps need to be properly hung up for storage to protect the visor and the cap body. When there are a large number of baseball caps that need to be stored, standardized storage methods need to be used.

In prior art, when a large number of baseball caps need to be stored, the common storage methods are as follows:

(1) each baseball cap is hung with a hook, which takes up a lot of space and is not firm, so the cap is easy to fall off;

(2) baseball caps are nested and stacked together; if the stacking state is not destroyed, the cap stored in the middle is not easy to remove;

(3) a storage and display stand for ball caps disclosed in U.S. Pat. No. 5,566,837, which has an overly complex structure.

SUMMARY

The invention aims at providing a hat rack for baseball cap so as to store a large number of baseball caps in a more standardized manner, so that the caps are not easy to fall off, a single cap is easier to take and put, and the structure is simple and reliable.

In order to achieve above purpose, the invention employs the following technical solutions:

A hat rack for baseball includes a main body, wherein the main body is provided with a vertical support surface, and the support surface is provided with a plurality of connection ports arranged in a row from top to bottom; each of the connection ports is provided with a lower support platform and an upper positioning platform located above the lower support platform respectively, a bottom surface of the upper positioning platform and a top surface of the lower supporting platform are clearance-matched, and the bottom surface of the upper positioning platform forms a limiting portion which sinks upward.

In an improved solution, the support surface is provided with a plurality of horizontal partitions arranged in a row from top to bottom, and every two vertically-adjacent horizontal partitions are combined to form the connection port; in each of the connection ports, the horizontal partition located above is provided with a downwardly-extending rib on one side away from the support surface; the upper positioning platform is composed of the horizontal partition located above, and the lower support platform is composed of a horizontal partition located below; the limiting portion is composed of a region of the upper positioning platform located at an inner edge of the rib.

Preferably, the rib forms an outward arc-shaped curved wall in a middle section in a horizontal direction.

In another improved solution, the upper positioning platform is of a flat plate structure extending horizontally forward on the support surface, and the limiting portion is a through hole vertically penetrating the upper positioning platform.

In another improved solution, the lower support platform is of a flat plate structure extending horizontally forward on the support surface.

In another improved solution, the lower support platform is a pair of support arms extending horizontally forward on the support surface, and the support arms are arranged in parallel in the horizontal direction and symmetrically arranged on both sides of the upper support platform.

In another improved solution, a top end of the main body is provided with a hook.

Preferably, there are two main bodies disposed back to back; an upper end of the main body is provided with a first through hole normal to the support surface, and the first through holes on the two main bodies are coaxially aligned; a lower end of the hook is provided with a U-shaped opening, the two main bodies disposed back to back just fit the upper ends into the U-shaped opening, and a lower end of the hook is provided with a bolt which cross both ends of the U-shaped opening, the bolt being connected through the first through hole on the main body.

In another improved solution, a bottom end of the main body is provided with a base.

Preferably, there are two main bodies disposed back to back; the upper end of the main body is provided with a plug-in end, an upper end of the base is provided with a socket, and the two main bodies disposed back to back just insert the plug-in end into the socket side by side.

In another improved solution, the main body is provided with an adhesive surface located at a back of the support surface, and a back adhesive is provided on the adhesive surface.

In another improved solution, the main body is provided with two support surfaces disposed back to back.

In another improved solution, the upper end of the main body is provided with a second mounting hole which is normal to the support surface.

Further, a lower end of the main body is provided with a third mounting hole which is normal to the support surface.

Compared with the prior art, the invention may store a large number of baseball caps in a more standardized manner, so that the caps are not easy to fall off, a single cap is easier to take and put, and the structure is simple and reliable.

The invention will be further described in detail in combination with drawings and the specific embodiments.

DETAILED DESCRIPTION OF THE EMBODIMENTS

Figure 1:
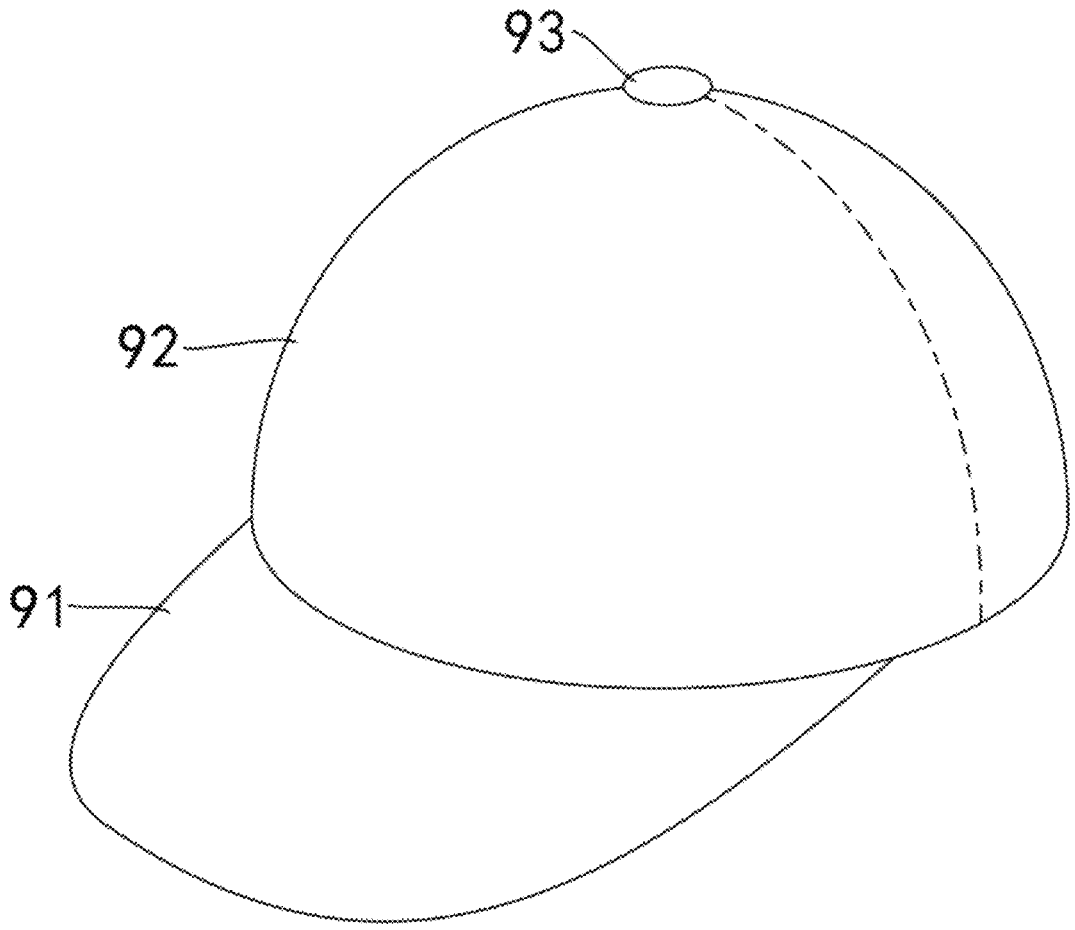
FIG. 1 is a structural diagram of a baseball cap in the prior art.
Figure 2:
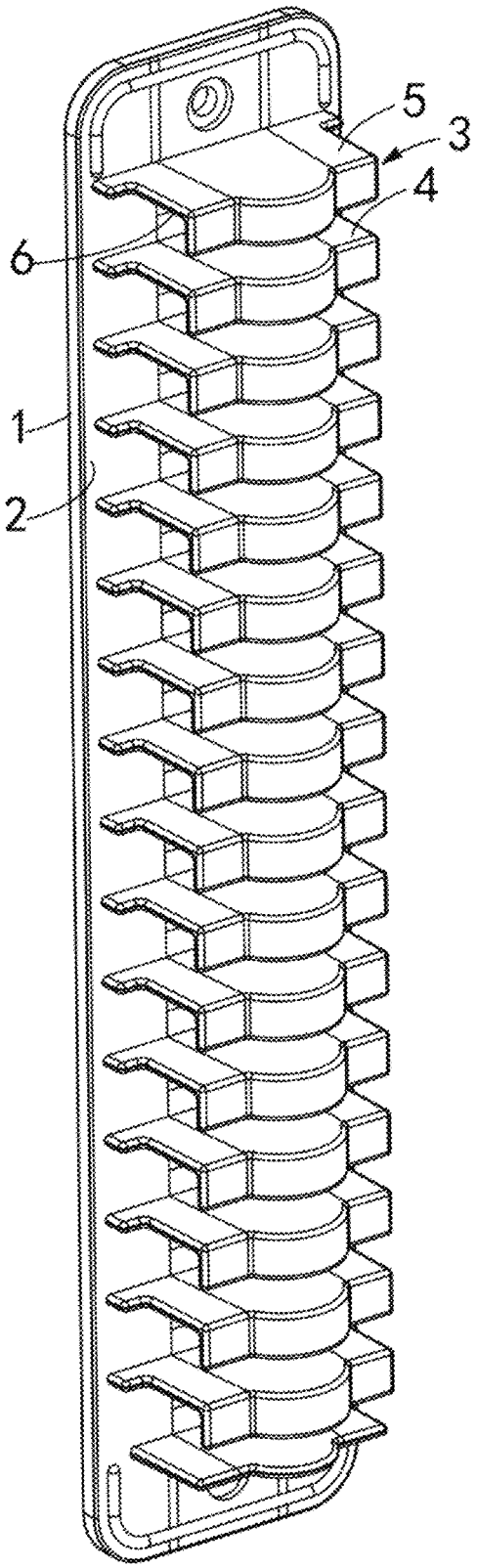
FIG. 2 is one structural diagram of the invention.

With reference to FIG. 2, a hat rack for baseball according to the invention includes a main body 1, wherein the main body 1 is provided with a vertical support surface 2, and the support surface 2 is provided with a plurality of connection ports 3 arranged in a row from top to bottom; each of the connection ports 3 is provided with a lower support platform 4 and an upper positioning platform 5 located above the lower support platform 4 respectively, a bottom surface of the upper positioning platform 5 and a top surface of the lower supporting platform 4 are clearance-matched, and the bottom surface of the upper positioning platform 5 forms a limiting portion 6 which sinks upward.

Figure 3:
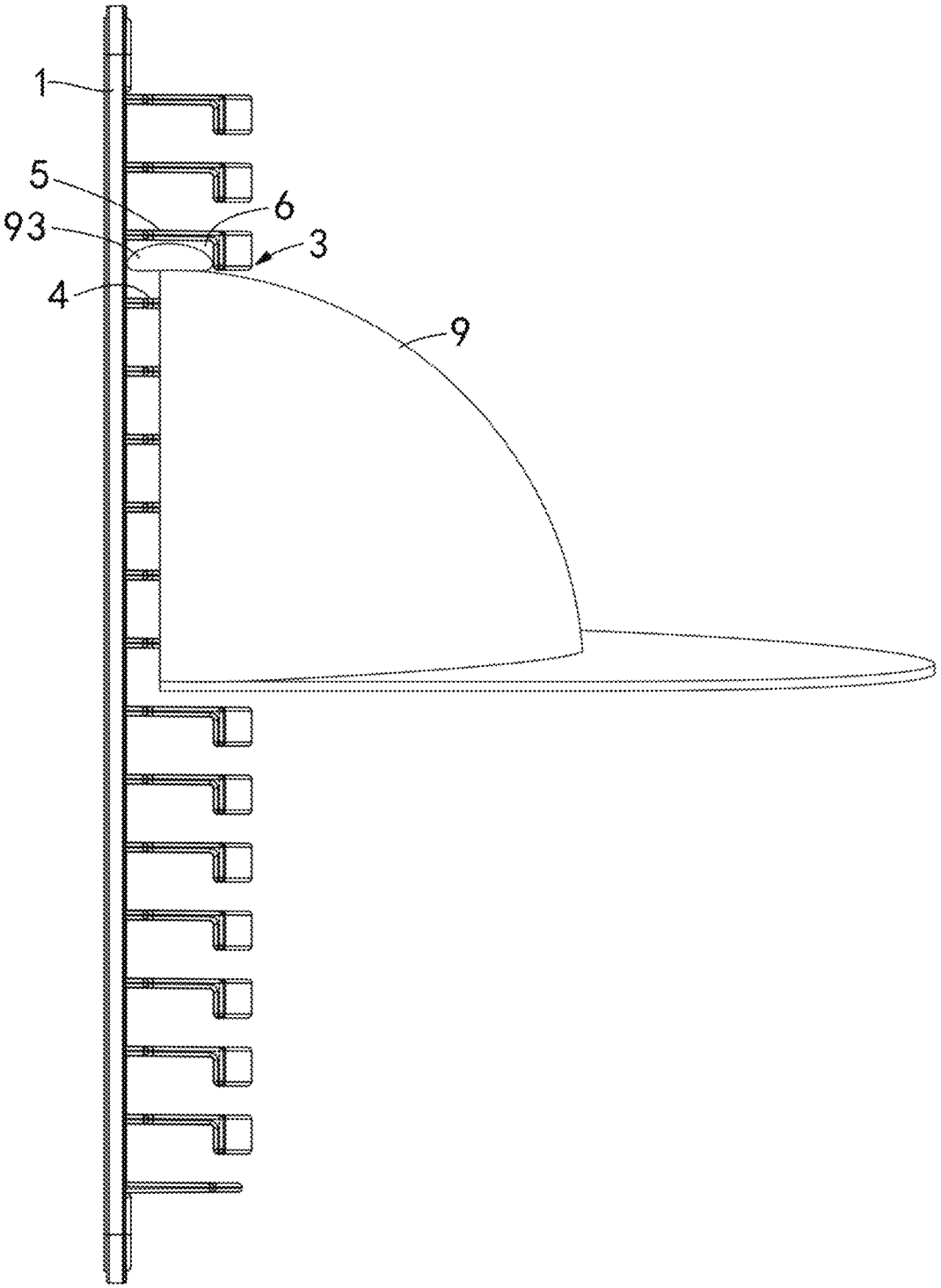
FIG. 3 is reference diagram one of the invention in use state.

As shown in FIG. 3, when a baseball cap 9 is stored by means of the invention, the main body 1 is kept in a vertical position, a rear half of the cap body 92 is folded inward with a top buckle 93 of the baseball cap as the center so that the cap body of the baseball cap is roughly a quarter of a spherical shell, and then a rear edge of the folded baseball cap is inserted into the connection port 3 on the support surface 2. Specifically, the rear edge of the folded baseball cap is inserted into a gap between the bottom surface of the upper positioning platform 5 and the top surface of the lower support platform 4, and the top buckle of the baseball cap is also embedded into the limiting portion 6 of the bottom surface of the upper positioning platform 5. Then, it can be found that the baseball cap rests on the lower support platform 4 under the action of gravity, and the limiting portion 6 on the bottom surface of the upper positioning platform 5 interferes with the top buckle of the baseball cap; therefore, the baseball cap will eventually remain on the connection port 3 of the support surface 2 in a nearly horizontal posture, but will not fall out of the connection port 3 easily.

Figure 4:
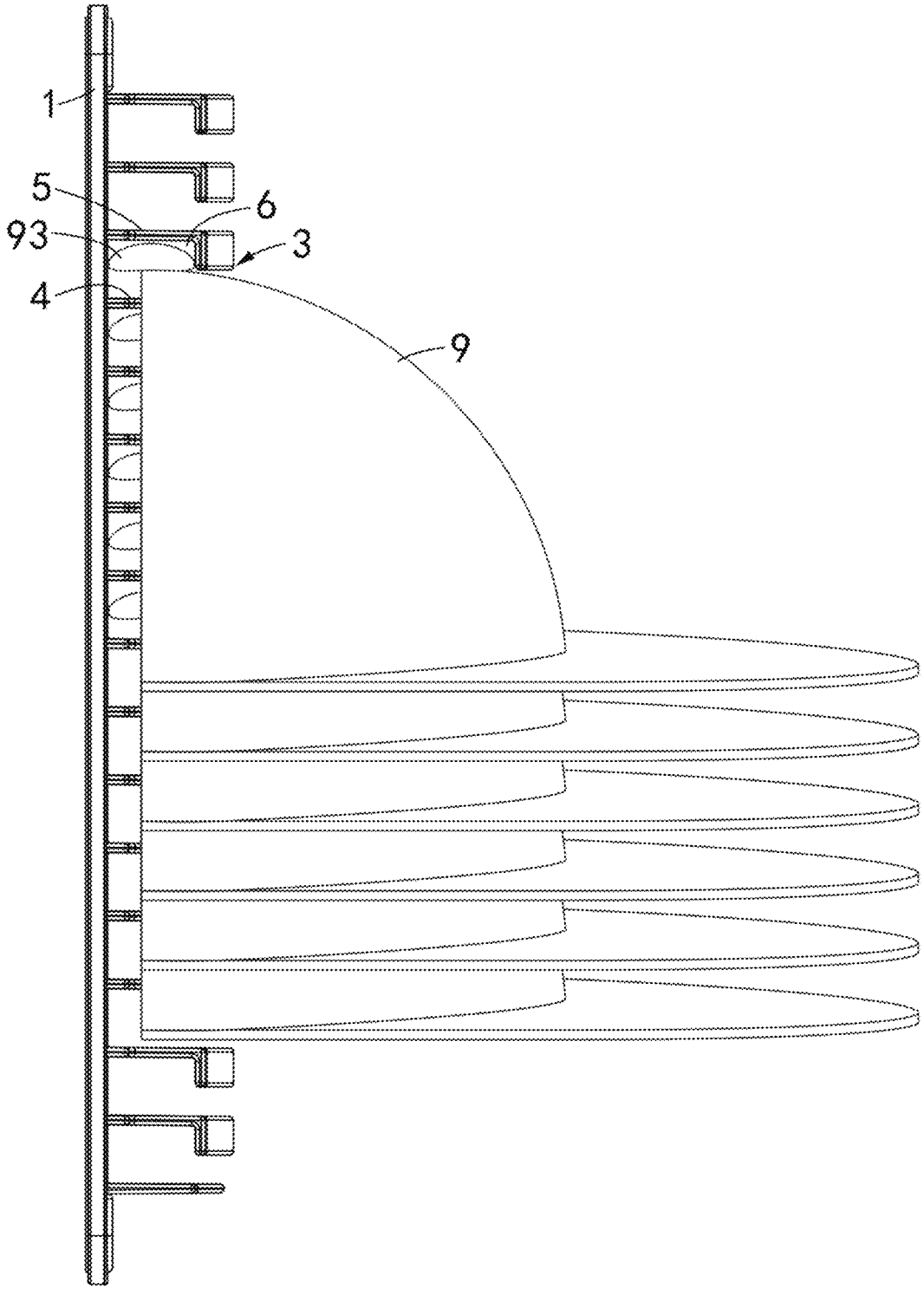
FIG. 4 is reference diagram two of the invention in use state.

Since the support surface 2 is provided with a plurality of connection ports 3 arranged in a row from top to bottom, a large number of baseball caps 9 may be stored as shown in FIG. 4. When a baseball cap needs to be taken out separately, only by removing the top buckle from the limiting portion 6 can the interference of the limiting portion 6 on the top buckle be relieved, and then the corresponding baseball cap may be released separately from the connecting port 3 where it is located.

Figure 5:
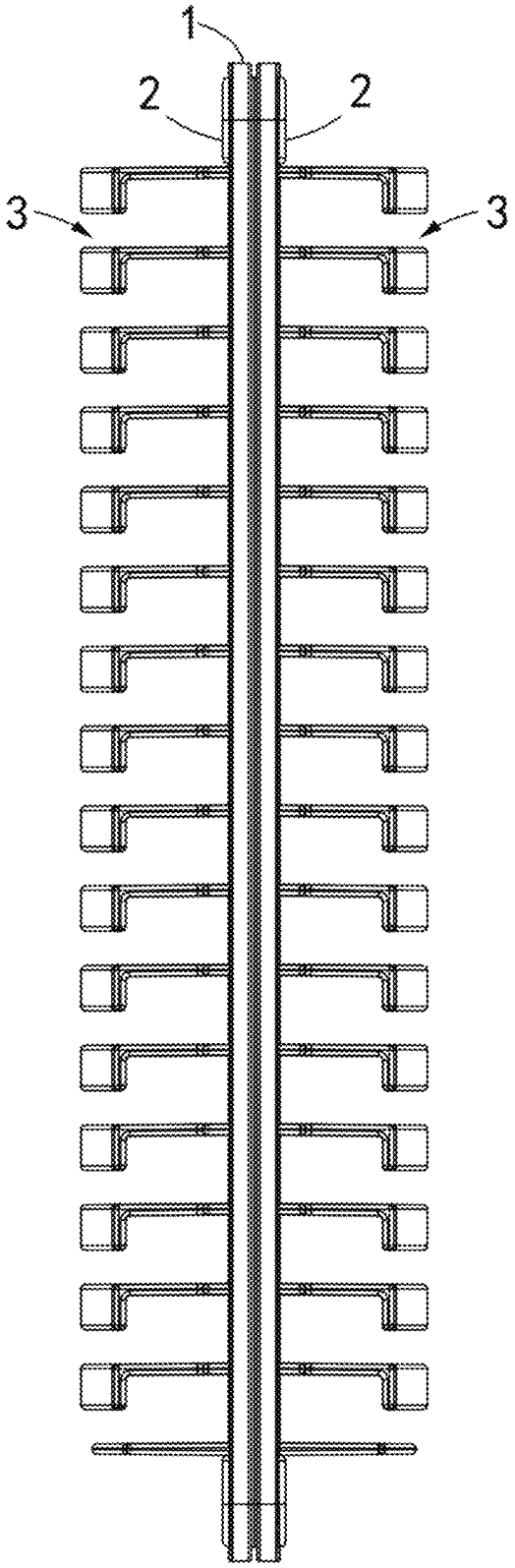
FIG. 5 is the other structural diagram of the invention.

Preferably, as shown in FIG. 5, the main body 1 is provided with two support surfaces 2 disposed back to back, and then more connection ports 3 may be disposed on the main body 1, thereby storing more baseball caps.

For ease of understanding, the invention will use two embodiments to illustrate how to interfere with the top buckle through the limiting portion 6.

Embodiment One

Figure 6:
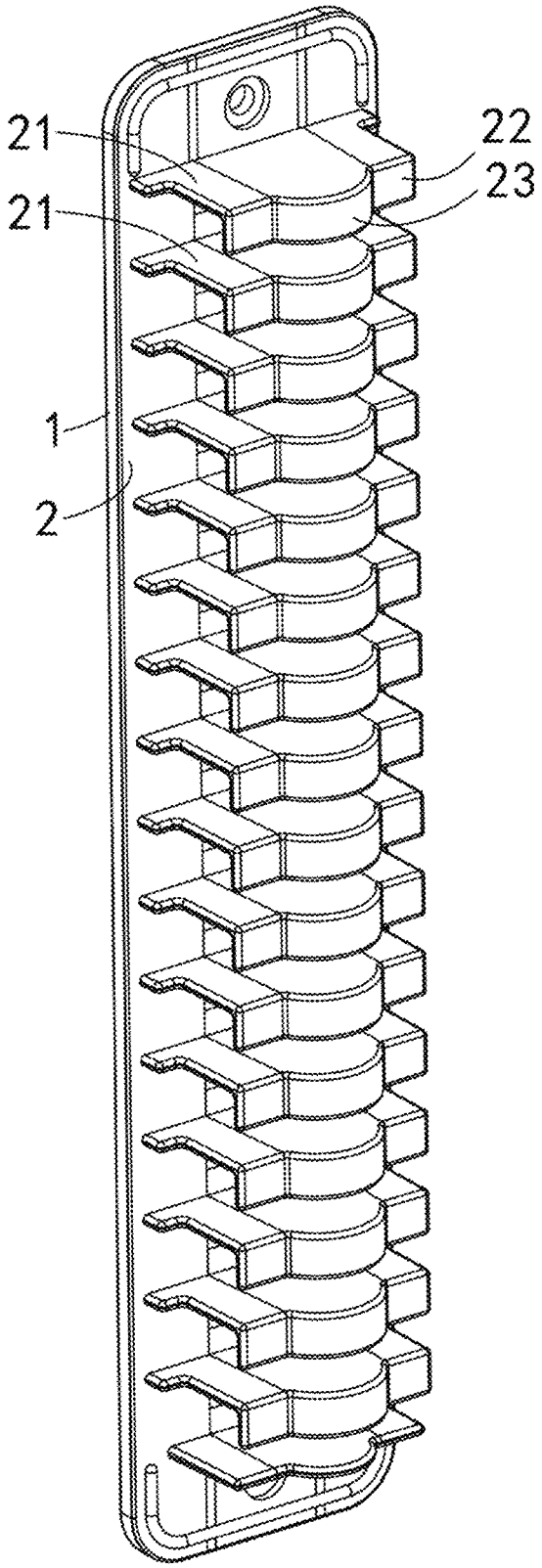
FIG. 6 is a structural diagram of Embodiment One of the invention.
Figure 7:
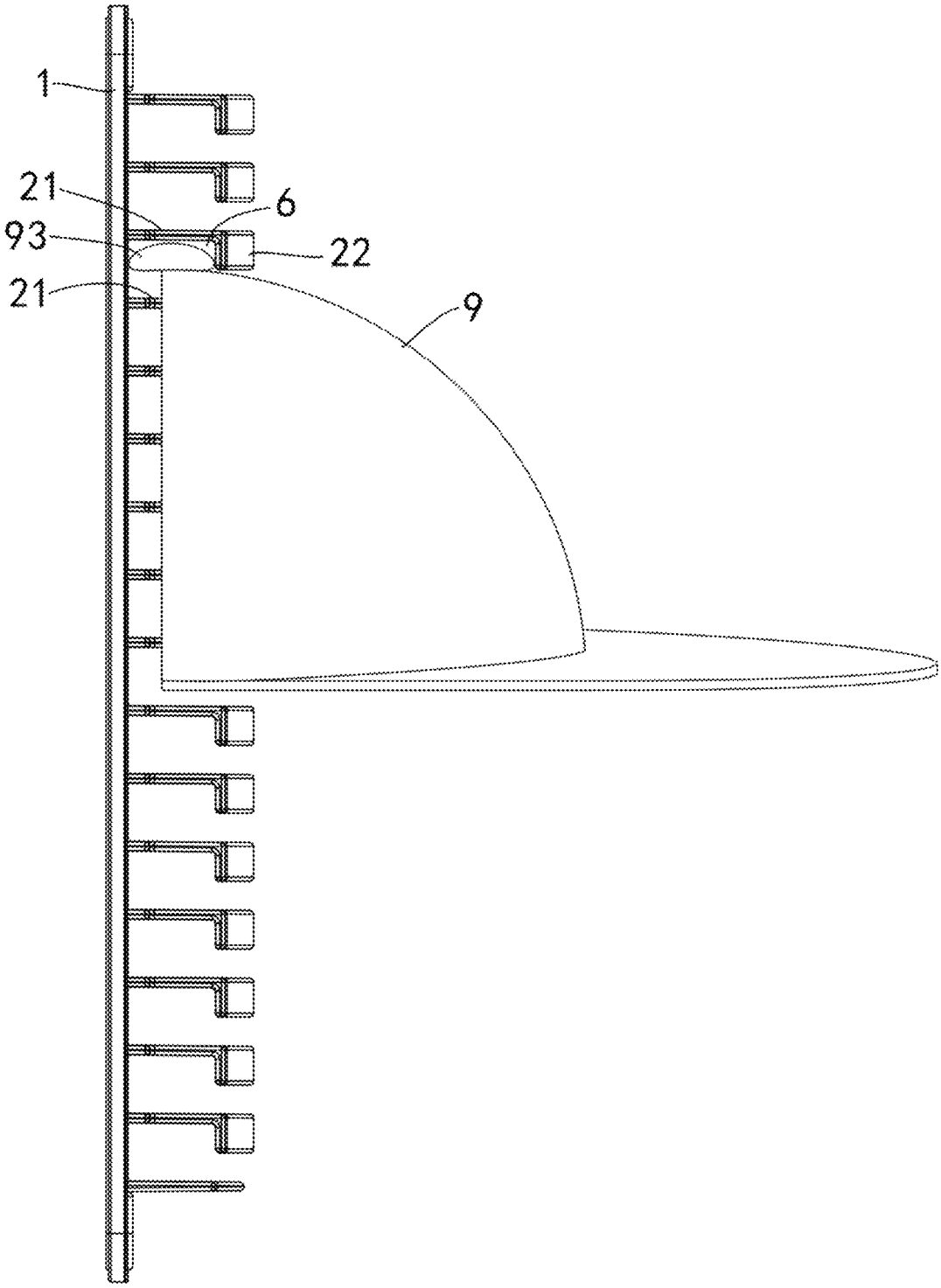
FIG. 7 is a diagram of the working principles of Embodiment One of the invention.

As shown in FIGS. 6 and 7, the support surface 2 is provided with a plurality of horizontal partitions 21 arranged in a row from top to bottom, and every two vertically-adjacent horizontal partitions 21 are combined to form the connection port 3; in each of the connection ports 3, the horizontal partition located 21 above is provided with a downwardly-extending rib 22 on one side away from the support surface 2; the upper positioning platform 5 is composed of the horizontal partition located above, and the lower support platform 4 is composed of a horizontal partition located below; the limiting portion 6 is composed of a region of the upper positioning platform 5 located at an inner edge of the rib 22.

In Embodiment One, two sides of the upper and lower adjacent horizontal partitions in each of the connection ports 3 will form an open channel. The rear edge of the folded baseball cap is inserted into the gap between the upper and lower adjacent horizontal partitions, and then the baseball cap is moved laterally until the top buckle of the baseball cap enters between the upper and lower adjacent horizontal partitions from outer sides of the horizontal partitions. Then, it can be found that the baseball cap rests on the horizontal partition serving as the lower support platform 4 under the action of gravity, and the baseball cap tends to tilt forward under the action of gravity so that the top buckle 93 of the baseball cap is blocked and interfered by the rib 22; therefore, the baseball cap will eventually remain on the connection port 3 of the support surface 2 in a nearly horizontal posture, but will not fall out of the connection port 3. The baseball cap is moved laterally again until the top buckle of the baseball cap moves from between the upper and lower adjacent horizontal partitions to the outer sides of the horizontal partitions, which will relieve the interference on the top buckle from the limiting portion 6 so that the corresponding baseball cap may be released separately from the connecting port 3 where it is located.

In Embodiment One, preferably the rib forms an outward arc-shaped curved wall 23 in a middle section in a horizontal direction. Obviously, since the top buckle of the baseball cap is usually round, the arc-shaped curved wall 23 on the rib will form a groove for a side edge of the top buckle to be embedded in, making the interference of the limiting portion 6 on the top buckle more reliable.

Embodiment Two

Figure 8:
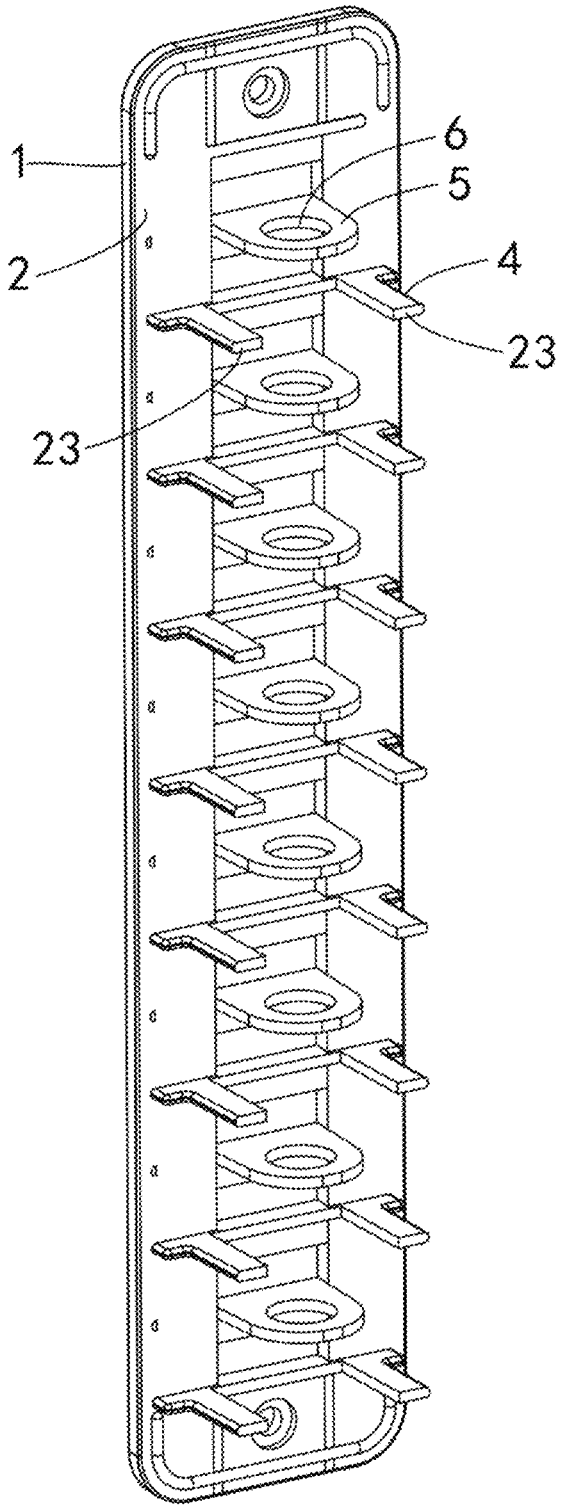
FIG. 8 is a structural diagram of Embodiment Two of the invention.
Figure 9:
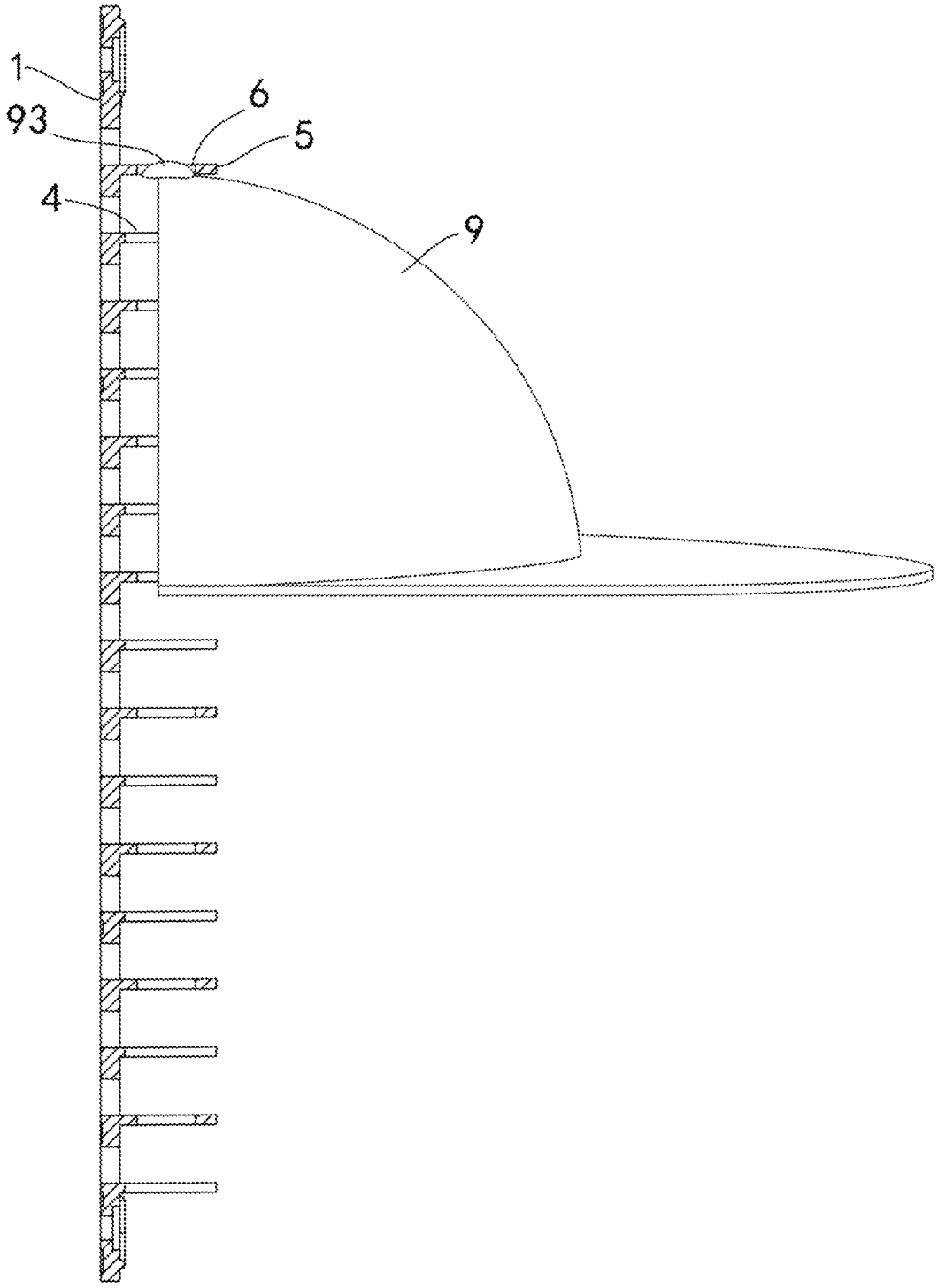
FIG. 9 is a diagram of the working principles of Embodiment Two of the invention.

As shown in FIGS. 8 and 9, in Embodiment Two, the structure of the connection port 3 is different from that in Embodiment One. The upper positioning platform 5 is of a flat plate structure extending horizontally forward on the support surface 2, and the limiting portion 6 is a through hole vertically penetrating the upper positioning platform 5. Optionally, the lower support platform 4 is of a flat plate structure extending horizontally forward on the support surface 2; or the lower support platform 4 is a pair of support arms 23 extending horizontally forward on the support surface 2, and the support arms 23 are arranged in parallel in the horizontal direction and symmetrically arranged on both sides of the upper support platform.

In Embodiment Two, the rear edge of the folded baseball cap is inserted into a gap between the bottom surface of the upper positioning platform 5 and the top surface of the lower support platform 4, and then the baseball cap is moved until the top buckle 93 of the baseball cap faces directly the through hole serving as the limiting portion 6, followed by embedding the top buckle 93 into the through hole serving as the limiting portion 6. Preferably, the through hole serving as the limiting portion 6 is tightly matched with the top buckle.

Then, it can be found that the baseball cap rests on the lower support platform 4 under the action of gravity, the baseball cap tends to tilt forward under the action of gravity, and the top buckle 93 of the baseball cap is tightly matched in the through hole serving as the limiting portion 6, i.e., the top buckle 93 is blocked and interfered in the horizontal direction; therefore, the baseball cap will eventually remain on the connection port 3 of the support surface 2 in a nearly horizontal posture, but will not fall out of the connection port 3. Until the top buckle is pushed downward out of the through hole serving as the limiting portion 6, the interference of the limiting portion 6 on the top buckle will be relieved, so that the corresponding baseball cap may be released from the connection port 3 where it is located.

In addition, for ease of understanding, the invention will use another four embodiments to illustrate how to keep the main body 1 in a vertical posture.

Embodiment Three

Figure 10:
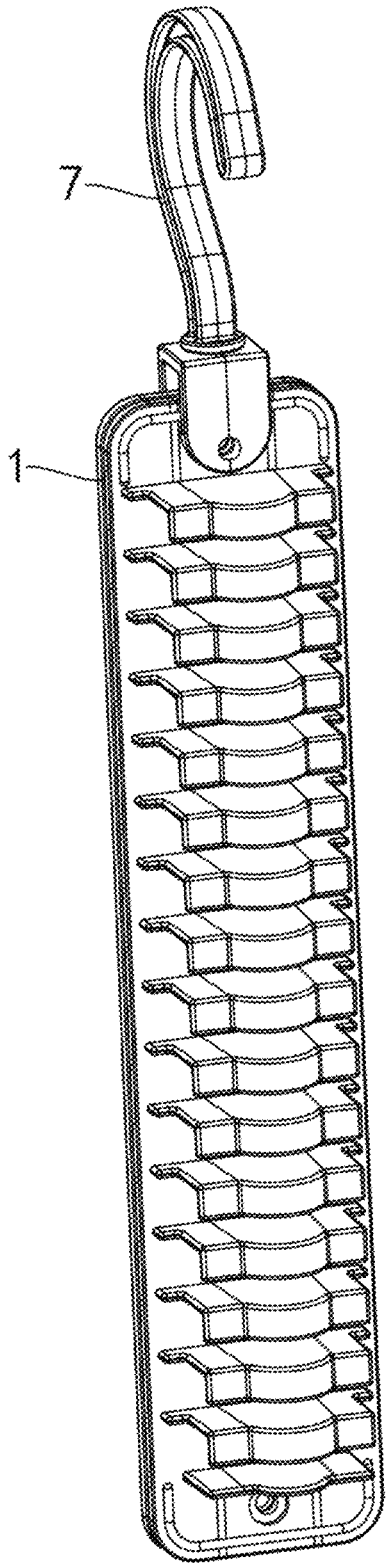
FIG. 10 is a structural diagram of Embodiment Three of the invention.
Figure 11:
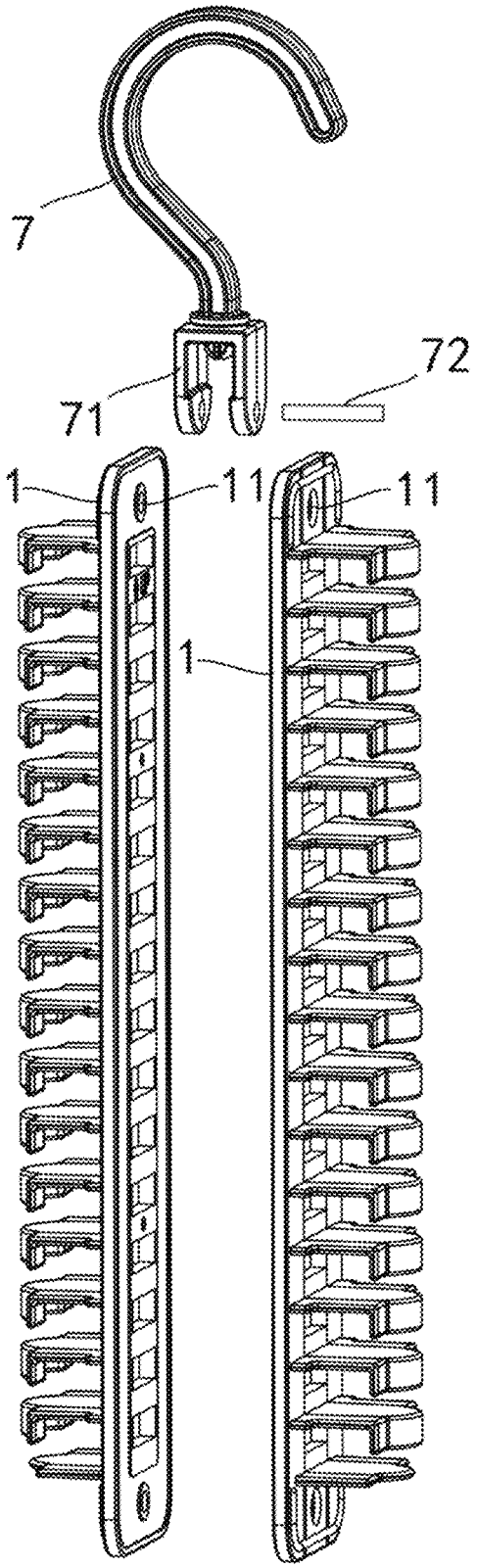
FIG. 11 is an exploded diagram of Embodiment Three of the invention.

As shown in FIGS. 10 and 11, in Embodiment Three, a top end of the main body 1 is provided with a hook 7. This is very easy to understand; by hanging the main body 1 through the hook 7, the main body 1 may be kept in a vertical hanging posture.

In Embodiment Three, preferably, there are two main bodies 1 disposed back to back; an upper end of the main body 1 is provided with a first through hole 11 normal to the support surface 2, and the first through holes on the two main bodies 1 are coaxially aligned; a lower end of the hook 7 is provided with a U-shaped opening 71, the two main bodies 1 disposed back to back just embed the upper ends into the U-shaped opening 71, and a lower end of the hook 7 is provided with a bolt 72 which cross both ends of the U-shaped opening, the bolt being connected through the first through hole 11 on the main body 1.

Embodiment Four

Figure 12:
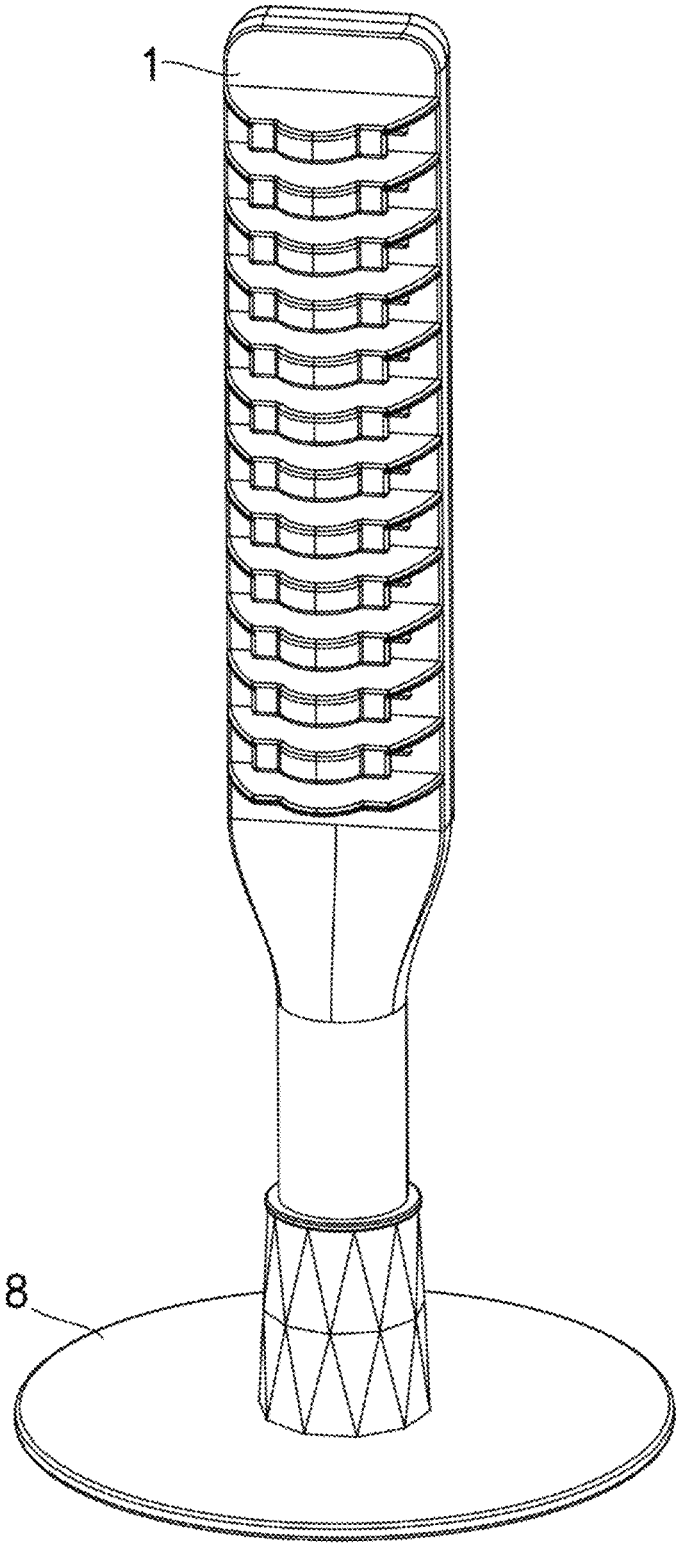
FIG. 12 is a structural diagram of Embodiment Four of the invention.
Figure 13:
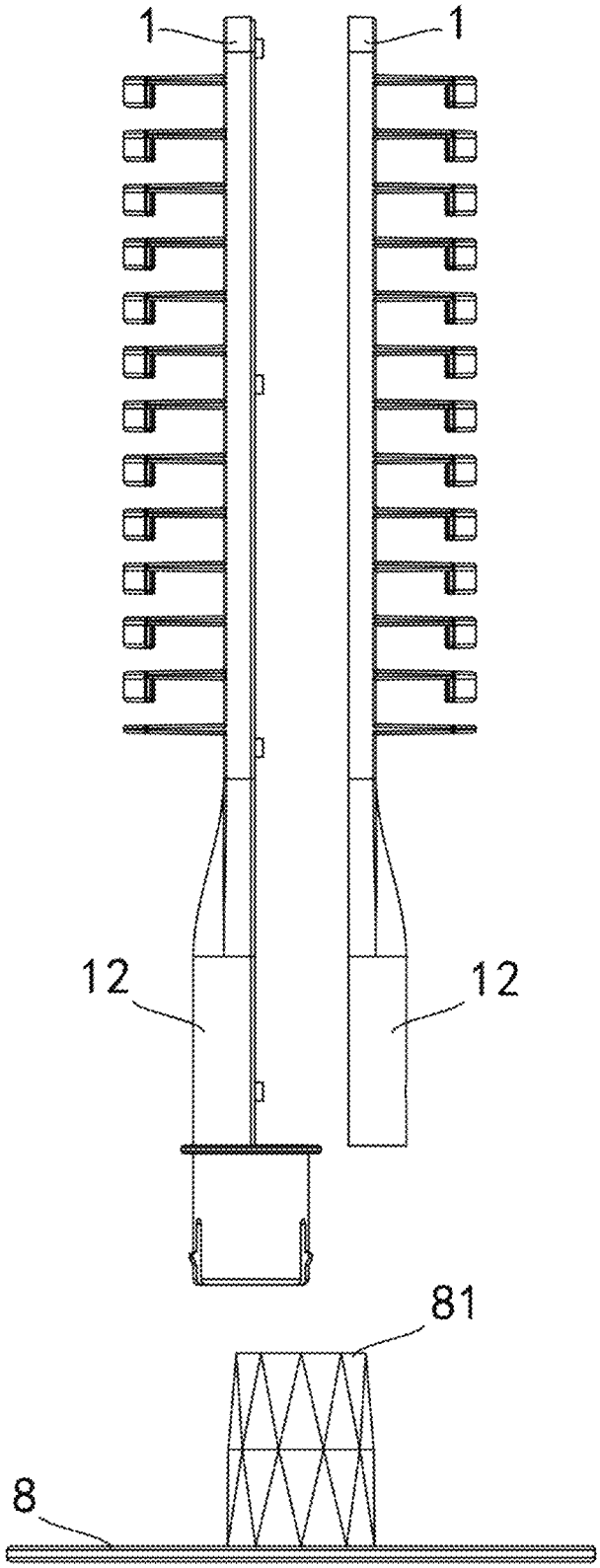
FIG. 13 is an exploded diagram of Embodiment Four of the invention.

As shown in FIGS. 12 and 13, in Embodiment Three, a bottom end of the main body 1 is provided with a base 8. The main body 1 may be placed vertically on a fixed plane, such as a desktop, through the base 8 to keep the main body 1 in a vertical standing position.

In Embodiment Four, preferably, there are two main bodies 1 disposed back to back; the upper end of the main body 1 is provided with a plug-in end 12, an upper end of the base 8 is provided with a socket 81, and the two main bodies 1 disposed back to back just insert the plug-in end into the socket 81 side by side.

Embodiment Five

Figure 14:
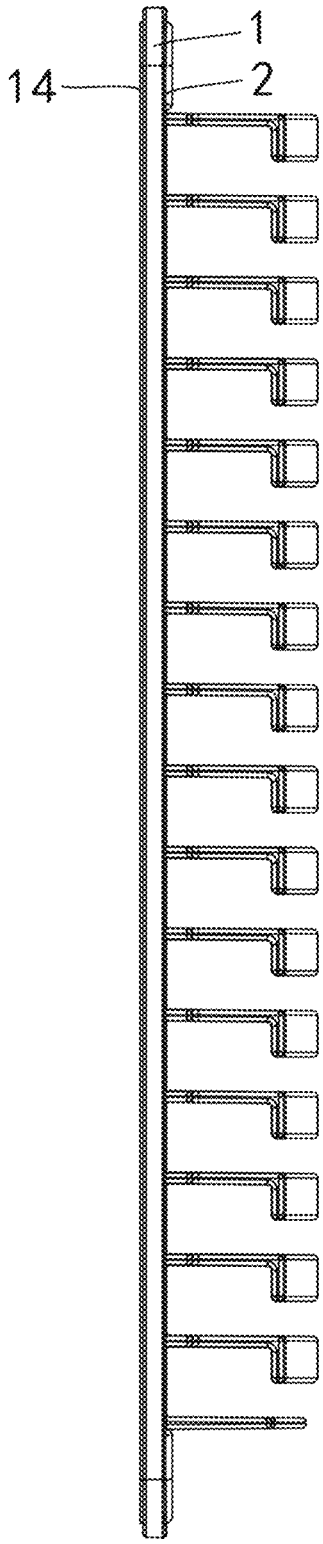
FIG. 14 is a structural diagram of Embodiment Five of the invention.

As shown in FIG. 14, in Embodiment Five, the main body 1 is provided with an adhesive surface located at a back of the support surface 2, and a back adhesive 14 is provided on the adhesive surface. The main body 1 may be attached vertically on a fixed plane, such as a wall surface, through the back adhesive 14 to keep the main body 1 in a vertical position.

Embodiment Six

Figure 15:
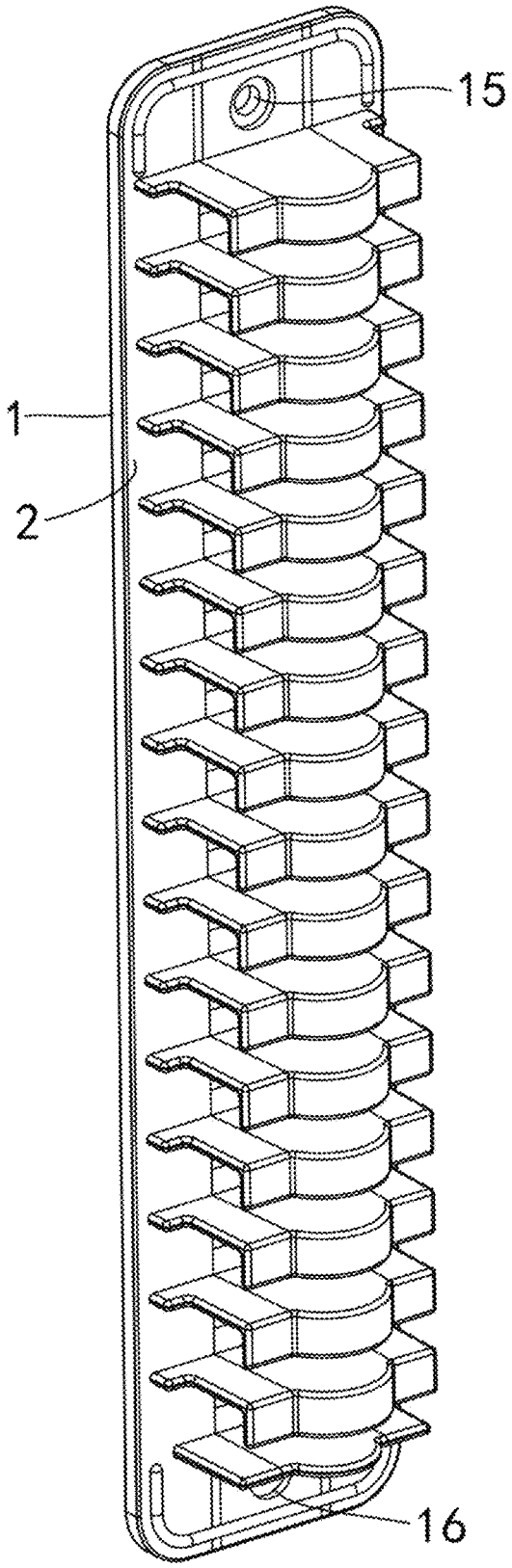
FIG. 15 is a structural diagram of Embodiment Six of the invention.

As shown in FIG. 15, in Embodiment Six, the upper end of the main body 1 is provided with a second mounting hole 15 which is normal to the support surface 2. The main body 1 may be vertically mounted on a fixed plane, such as a wall surface, by passing screws through the second mounting hole 15, so that the main body 1 may be kept in a vertically hanging posture.

In Embodiment Five, preferably, a lower end of the main body 1 is provided with a third mounting hole 16 which is normal to the support surface 2. The main body 1 may be vertically mounted on a fixed plane, such as a wall surface, by passing screws through the second mounting hole 15 and the third mounting hole 16 respectively, so that the main body 1 may be kept in a vertical posture more stably.

Although the embodiments of the present invention have been shown and described, it can be understood that a person skilled in the art can make various changes, modifications, substitutions and variations to the embodiments without departing from the principle and spirit of the present invention; and the scope of the present invention is defined by the attached claims and equivalents thereof.

What is claimed is:

1. A hat rack for baseball, comprising a main body, wherein the main body is provided with a vertical support surface, and the vertical support surface is provided with a plurality of connection ports arranged in a row from top to bottom; each of the connection ports is provided with a lower support platform and an upper positioning platform located above the lower support platform respectively, a bottom surface of the upper positioning platform and a top surface of the lower supporting platform are clearance-matched, and the bottom surface of the upper positioning platform forms a limiting portion, wherein there are two of said main bodies disposed back to back; an upper end of each of the main bodies is provided with a first through hole normal to the vertical support surface, and the first through holes on the two main bodies are coaxially aligned; top ends of the main bodies are provided with a hook, a lower end of the hook is provided with a U-shaped opening, the two main bodies disposed back to back; wherein the upper ends of the two main bodies are fitted into the U-shaped opening, and the lower end of the hook is provided with a bolt which cross both ends of the U-shaped opening, the bolt being connected through the first through hole on the main bodies.

2. The hat rack for baseball cap according to claim 1, wherein the vertical support surface is provided with a plurality of horizontal partitions arranged in a row from top to bottom, and every two vertically-adjacent horizontal partitions are combined to form the connection port; in each of the connection ports, the horizontal partition located above is provided with a downwardly-extending rib on one side away from the vertical support surface; the upper positioning platform is composed of the horizontal partition located above, and the lower support platform is composed of a horizontal partition located below; the limiting portion is composed of a region of the upper positioning platform located at an inner edge of the rib.

3. The hat rack for baseball cap according to claim 2, wherein the rib forms an outward arc-shaped curved wall in a middle section in a horizontal direction.

4. The hat rack for baseball cap according to claim 1, wherein the upper positioning platform is of a flat plate structure extending horizontally forward on the vertical support surface, and the limiting portion is a through hole vertically penetrating the upper positioning platform.

5. The hat rack for baseball cap according to claim 1, wherein the lower support platform is of a flat plate structure extending horizontally forward on the vertical support surface.

6. The hat rack for baseball cap according to claim 1, wherein the lower support platform is a pair of support arms extending horizontally forward on the vertical support surface, and the support arms are arranged in parallel in the horizontal direction and symmetrically arranged on both sides of the upper positioning platform.

7. The hat rack for baseball cap according to claim 1, wherein each of the main bodies is provided with an adhesive surface located at a back of the vertical support surface, and a back adhesive is provided on the adhesive surface.

8. The hat rack for baseball cap according to claim 1, wherein the main bodies are provided with two back support surfaces disposed back to back.

9. The hat rack for baseball cap according to claim 7, wherein a lower end of each of the main bodies is provided with a mounting hole which is normal to the vertical support surface.

* * * * *